United States Patent [19]

Forrest et al.

[11] Patent Number: 4,703,831

[45] Date of Patent: Nov. 3, 1987

[54] FIRE ESCAPE APPARATUS FOR USE IN MULTI-STORY BUILDINGS AND METHOD OF ESCAPE

[75] Inventors: William E. Forrest, Denver; David H. Glabe, Arvada; Michael K. Wegman, Brighton, all of Colo.

[73] Assignee: Forest Safety Products, Inc., Denver, Colo.

[21] Appl. No.: 870,702

[22] Filed: Jun. 4, 1986

[51] Int. Cl.[4] ..... A62B 1/16; A62B 35/00

[52] U.S. Cl. ..... 182/3; 182/42; 182/82

[58] Field of Search ..... 182/10, 42, 43, 44, 182/150, 142, 145, 82, 73–75, 3, 5

[56] References Cited

U.S. PATENT DOCUMENTS

| | | | |
|---|---|---|---|
| 179,515 | 7/1876 | Bustin . | |
| 293,322 | 2/1884 | Griswold . | |
| 317,704 | 5/1885 | Beale et al. . | |
| 323,092 | 7/1885 | Werner | 182/42 |
| 426,540 | 4/1890 | Matthaes . | |
| 955,243 | 4/1910 | Witt | 182/42 |
| 1,852,887 | 4/1932 | Lossius . | |
| 3,459,276 | 8/1969 | Fuse . | |
| 3,759,346 | 9/1973 | Brda . | |
| 3,760,901 | 9/1973 | Hynes . | |
| 3,844,377 | 10/1974 | Wilkins . | |
| 4,440,261 | 4/1984 | Clark . | |
| 4,538,704 | 9/1985 | Forrest . | |

FOREIGN PATENT DOCUMENTS

| | | | |
|---|---|---|---|
| 267817 | 1/1969 | Austria | 182/82 |

*Primary Examiner*—Reinaldo P. Machado
*Attorney, Agent, or Firm*—Sheridan, Ross & McIntosh

[57] ABSTRACT

An apparatus and method for lowering a plurality of evacuees in a single descent using a movable rope system is provided. An anchor is equipped with expansion means for wedging the anchor between a floor and ceiling. An arm extends outward from the anchor and is supported by a leg extending to the floor. The leg is braced to the expandable floor-to-ceiling member to resist tilting of the anchor. A friction drum is provided to control the descent of evacuees and also to provide for braking of the rope in order to attach harnesses for use by evacuees. A first evacuee is attached to an end of the rope and lowered a distance whereupon the rope is braked. A second evacuee is then attached and lowered and the rope is again braked. In this manner, a plurality of evacuees are attached to the first end of the rope which is then lowered to the destination point. The next group of evacuees is attached in similar fashion to the second end of the rope and the weight of the second group of evacuees is used as a counterweight in hauling up the first portion of the rope and harnesses.

14 Claims, 3 Drawing Figures

FIRE ESCAPE APPARATUS FOR USE IN MULTI-STORY BUILDINGS AND METHOD OF ESCAPE

FIELD OF THE INVENTION

This invention relates to an apparatus for use in escaping a fire or other disaster which occurs in a multistory building, and in particular to a method and an apparatus for multi-person use employing a movable rope system.

BACKGROUND INFORMATION

Since before the turn of the century, devices and methods for escaping emergencies in high-rise buildings have been proposed. The majority of these are directed to single person escape methods, i.e. a system in which each escapee is lowered to the desired destination point before attaching or engaging the next person to the escape system. Very few methods have addressed the problems of multi-person escape systems. Among the problems which must be solved by a multi-person escape system are that deployment of the first evacuee must not interfere with accessibility to the system by the next evacuee and the system must allow for unattended escape of the last evacuee, i.e. the system must not require operation or adjustment by personnel at the top of the system during descent of the last group of evacuees.

Some multi-person escape systems have employed a fixed rope system, i.e. a system in which a single rope is hung in immovable fashion from the escape location and the evacuees slide or ride down the rope using a number of different types of sliding or rolling attachment devices. Typical of such systems are U.S. Pat. No. 3,459,276, issued Aug. 5, 1969 to Fuse and U.S. Pat. No. 1,852,887, issued Apr. 5, 1932 to Lossius. The fixed rope system has certain disadvantages. The rate of descent of each person on a fixed rope system must be controlled in such a manner that a person higher on the system does not descent at a significantly faster rate than a person lower on the system, so as to cause collision between the two evacuees. Prevention of such collision often means that the evacuees must have at least some rudimentary training in the use of the descent system so as to control their own rate of descent. Alternatively, some mechanism or apparatus must be provided to keep the proper spacing between evacuees. Because of these problems, effective fixed rope systems are difficult to design.

Certain single-person evacuation systems have employed a movable rope system, i.e. a system in which the evacuee is attached to the rope in a fixed relationship with respect to the rope and the rope itself is lowered. Examples of such systems include U.S. Pat. No. 3,760,901, issued Sept. 25, 1973 to Hynes and U.S. Pat. No. 3,759,346, issued Sept. 18, 1973 to Brda. Adaption of such movable rope systems to a multiple evacuation situation has presented a number of difficult problems. The system must be provided with a braking device so that after the first evacuee has moved downward, the rope can be stopped for attachment of the next evacuee. This braking system, however, should be of simple design with as few moving parts as possible to minimize the possibility of malfunction which could potentially strand evacuees in mid-air. The system should be usuable by inexperienced or novice persons. Systems such as depicted in U.S. Pat. No. 179,515, issued July 4, 1876 to Bustin when used for multi-person evacuation, require repeated raising of the rope and attached equipment such as a harness which might prove unwieldy to inexperienced or novice persons. This difficulty is even more severe in very high-rise buildings requiring a long length of rope.

A further reason for desiring to minimize the weight and unwieldiness of an escape system relates to the fact that when a fire occurs in a high-rise building, it cannot be predicted from which portion of the building escape by a rope system might be possible. Since it may be economically infeasible to provide permanently attached escape systems at each possible escape location throughout a building, and since such permanent fixtures may be esthetically unpleasing as well as expensive, it is preferable to provide a system which can be positioned and quickly erected at any of a number of locations in the building.

It is also preferable to provide an escape system which can be provided in a form sufficiently portable that it can be carried into a burning building by one or two emergency personnel to provide for escape of, e.g. about 5 evacuees at a time when the building is not provisioned with an escape system, as well as in a form designed for use by about 10 evacuees simultaneously.

Whether the escape system is designed to be carried into a building or is to be provided in a number of locations throughout the building in anticipation of an emergency, it is beneficial if the system is adaptable to a number of different types of buildings. If the system is to be carried into a burning building, the system should be adaptable because the emergency personnel often cannot know the particular characteristics of the building. Even when the system is to be provided as a feature of the building itself, the cost of the escape system is lessened if the system does not have to be individually designed to meet the particular needs of the building. Many escape systems involve some type of attachment or amchorage to a wall or pillar or some weight-bearing function of a wall or pillar of the building. Typical of such systems are U.S. Pat. No. 3,844,377, issued Oct. 29, 1974 to Wilkins, U.S. Pat. No. 4,440,261, issued Apr. 3, 1984. U.S. Pat. No. 4,538,704, issued Sept. 3, 1985 to Forrest discloses horizontal braces that extend from an exit feature to a wall. Use of these systems, however, is at least partly confounded when the exterior of the building is floor to ceiling glass, as is common in many types of high-rise buildings. In such buildings, the structures most capable of bearing weight or stress are typically the floor and ceiling, generally being reinforced concrete or steel structures. Thus, greatest adaptability of the system is obtained when the anchorage for the system does not require that any significant weight or stress be borne by a wall member of the building.

In many emergency situations, it is desirable to raise emergency personnel from the ground to the site of the emergency, as well as to evacuate personnel from the site of the emergency. Previous escape systems were not particularly adaptable to such raising of emergency personnel, because this operation often involve postponing the departure of waiting evacuees and further required some amount of power or some relatively complex mechanism for hauling up personnel, often heavily laden with equipment.

A movable rope system, particularly a system which is to be heavily weighed such as by attachment of a plurality of evacuees, requires somes means to avoid running the movable rope over a sharp edge such as a window ledge or edge of a balcony, etc. One method of accomplishing this objective involves anchoring the rope at the destination point some distance away from the base of the building so that the rope takes on a slanted or angled configuration with respect to the building. As depicted in U.S. Pat. No. 317,704 issued May 12, 1885 to Beale, et al., U.S. Pat. No. 426,540, issued Apr. 29, 1890 to Matthaes and U.S. Pat. No. 293,322, issued Feb. 12, 1884 to Griswold. Such a system, however, puts great stress on the rope and any ground anchors and requires some anchoring mechanism at the ground which ordinarily means that a trained ground crew and often ground based equipment or fixtures must be provided.

Another method for avoiding running the rope over a sharp edge is providing an arm or cantilever beam projecting from the building. Previous beam-type devices such as those depicted in U.S. Pat. No. 3,844,377, issued Oct. 29, 1974 to Wilkins and U.S. Pat. No. 3,459,276, issued Aug. 5, 1969 to Fuse have required heavy support, often necessitating transmittal of force to some portion of a wall, and normally could not be used with more than a few persons, and thus could not be used to evacuate 10 or more persons in a single descent.

SUMMARY OF THE INVENTION

The present invention relates to a multi-person escape system using a movable rope. The rope hangs from an arm or over an atrium or elevator shaft which extends outward of the side of a building. The arm is held in place by an anchor. The anchor can be wedged between a floor and ceiling such that all the weight and stress incurred during evacuation is transmitted to the floor and ceiling, and the apparatus does not depend upon transmitting any substantial stress to a wall, pillar or any internal structure other than a floor or ceiling. The arm is connected to the anchor in such a way that the weight of the evacuees and equipment attached to the rope causes a force to be transmitted in substantially upward and downward vertical directions, to avoid tilting the anchor out of vertical alignment. A leg extends from a mid-portion of the arm to the floor to act as a fulcrum for the cantilever arm. This leg is preferably braced to the floor-to-ceiling member to also resist shifting of the anchor out of vertical alignment.

The rope is reaved about a friction drum, which acts as a device for controlling the rate of descent of the rope. The friction drum provides sufficient friction that descent of the rope, even when supporting 10 or more evacuees can be easily braked by manual pressure on a portion of the rope. Thus, the friction drum acts as both a descent control device and a braking device. The descent control device is of a simple design unlikely to be subject to mechanical failure.

In use, the anchor is erected so that the arm extends outward of the building or over another escape route such as an atrium or elevator shaft. A first evacuee is attached to a location along a first portion of the rope using a clamp of a commercially available type and lowered some distance using the friction drum. The friction drum is then employed to stop the descent to allow for attachment of the second evacuee. This process is repeated to achieve attachment of a number of evacuees, e.g. 10 evacuees to the first portion of the rope. The descent control device is then used to lower all of these evacuees to the destination point. The path of the rope is symmetric in the sense that once the first portion of the rope has been lowered to evacuate a first group of evacuees, a second portion of the rope can be used in an identical manner to lower a second group of evacuees. During the descent of the second group of evacuees, the weight of the evacuees provides the force necessary to haul back up the first portion of the rope and the empty harnesses. The weight of the second group can also be used to haul up fire fighting equipment and/or personnel using the control of an operator at the brake.

The apparatus is adaptable to use in a number of locations throughout a building so that it can be erected where escape is likely to be most effective. Because the rope hangs substantially vertically, and is not substantially inclined to the building, and because the arm member is relatively short, the apparatus is light-weight so that it can be positioned, preferably using attached wheels, and can be erected even by inexperienced or novice people. The apparatus of this invention can be provided in a light-weight form such that it can be carried into a building by one or two persons.

DETAILED DESCRIPTION OF THE INVENTION

Figure 1:
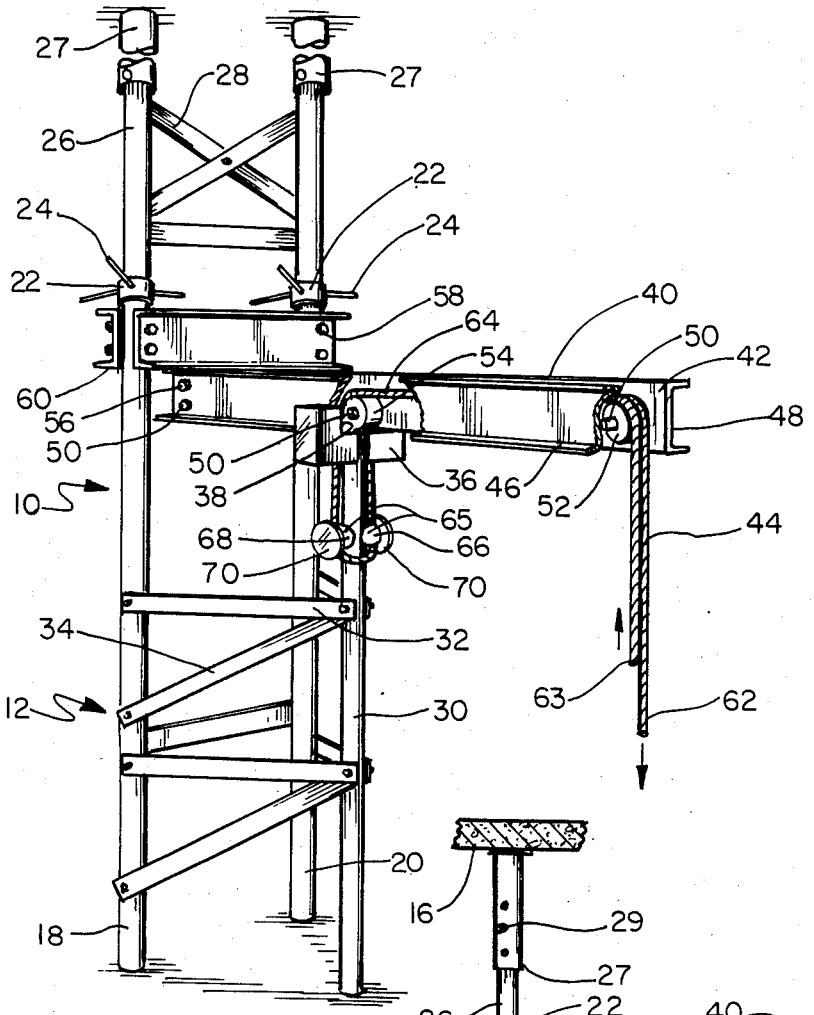
FIG. 1 is a perspective view of the apparatus of this invention with portions of the arm cut away to show the path of the rope.
Figure 2:
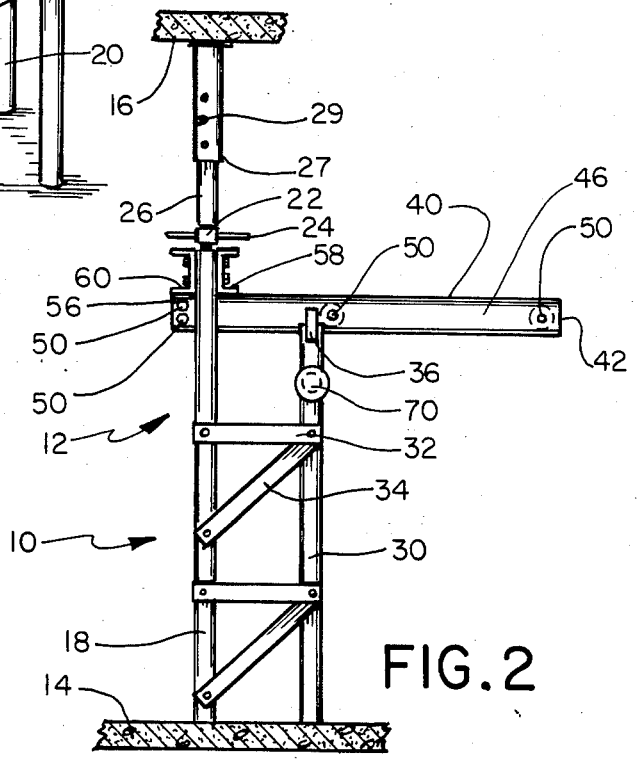
FIG. 2 is a side elevational view of the apparatus of this invention.

The present invention relates to a movable rope, single-rope system for multi-person evacuation from a multi-story building. Referring now to FIG. 1, the apparatus of the preferred embodiment of this invention comprises an anchor 10 including a first vertical member 12 extending between the floor 14 and ceiling 16 of a building. The first vertical member 12 comprises first and second struts 18, 20. Bracing 28 is provided between the first and second struts 18, 20. The struts 18, 20 are depicted in the form of tubular members, but can also be provided as posts, beams, or in a variety of other shapes, provided the struts have sufficient strength to withstand the forces imparted to the struts as described below. The struts 18, 20 are preferably made of a metallic material such as steel or aluminum, but can be of any material consistent with the strength requirements for the struts 18, 20. The struts 18, 20 are provided with expansion devices, preferably in the form of screw jacks 22, 24. Although the embodiment depicted in FIGS. 1 and 2 depict a device having two screw jacks, other embodiments can be used, including embodiments having a single screw jack or embodiments having more than two screw jacks. The screw jacks 22, 24 are provided at a height above the floor 14 such that they can be conveniently operated to vertically expand the struts 18, 20. The screw jacks 22, 24 are provided in a configuration such that rotating the screw jacks 22 using the handles 24 causes the upper portion 26 of the first vertical member 12 to move upwardly. The purpose of the screw jacks 22 is to provide for expansion of the first vertical member 12 such that it can be wedged securely between the floor 14 and ceiling 16 so as to support the weight of a plurality of evacuees.

The screw jacks 22 must have sufficient strength to withstand both the forces developed when expanding the first vertical member 12 and the additional forces which will be transmitted to the screw jacks by the weight of the plurality of evacuees, the rope, harnesses and so forth. Telescoping extensions 27 with lock pins 29 are provided for raising the ends of the struts 18, 20 sufficiently close to the ceiling that the screw jacks 22 can be operated to raise the upper portion 26 of the struts 18, 20 to contact the ceiling 16.

A second vertical member 30 is positioned proximate the first and second struts 18, 20 and preferably so that the second vertical member 30 is parallel to and equidistant from each of the first and second struts 18, 20. The second vertical member 30 is connected to the first and second struts 18, 20 by bracing 32, 34. The bracing preferably includes both horizontal braces 32 and inclined braces 34 to resist any tendency of the anchor 10 to tilt out of vertical alignment. The second vertical member 30 is depicted as being of a tubular form, but can be in the form of a post, beam, or other shape provided it has the stength to withstand the forces impressed thereon during use. The second vertical member 30 is preferably of a metallic material such as steel or aluminum, but can be of other materials having the necessary strength characteristics. Attached to the top of the second vertical member 30 is a retainer 36. The retainer 36 is in the form of a block of metal such as iron or aluminum having a slot 38 of a size and shape to cradle a portion of an arm member 40. The retainer 36 is attached to the second vertical member 30 by welding, bolting, or the like. The retainer 36 is centered atop the second vertical member 30 such that a vertical force imparted to the retainer 36 produces a substantially vertical force on the second vertical member 30. Although the retainer 36 is preferably made of a metallic material, it can be of other materials having the necessary strength characteristics. The arm member 40 is of a length sufficient that the free end 42 projects outward of the building a predetermined distance when the arm 40 is positioned as described below with respect to the first and second vertical members 12, 30 and the anchor 10 is positioned adjacent to an opening in the building such as a window, balcony, ledge, etc. The free end 42 of the arm 40 preferably extends about 10 to 12 inches outward of the building facade, and particularly outward of the edge of the floor 14 or any ledge or balcony extending from the floor 14. A 10 to 12 inch extension of the free end 42 of the arm 40 is sufficient in most cases to prevent friction or abrasion of the rope 44 against the building or a ledge or balcony of the building, and also sufficient to prevent collision of evacuees with a portion of the building. A larger extension of the free end of the arm 42 outward of the building can be provided, but at the expense of increased weight of the apparatus and increased moment arm, requiring strengthening of other portions of the apparatus. The free end 42 of the arm 40 must be sufficiently close to the building to permit reaching the rope 44, preferably without the use of tools or other equipment, so as to be able to attach an evacuee to the rope 44 when the rope 44 is hanging vertically. In most instances, an arm 40 having a length of about 3 feet will be operable. In the illustrated embodiment, the arm 40 includes two channel beams, i.e. beams each having a U-shaped cross-section. The first and second channel beams 46, 48 are joined by bolts 50 and are held apart by spacers. Provided in the space between the first and second beams 46, 48 are cylindrically shaped first and second rope guides 52, 54. The arm 40 can be provided in a form other than attached channel beams, such as tubular form, post, single I-beam, or other shapes provided the arm has sufficient strength to withstand the forces created by a plurality of evacuees hanging from the free end 42 of the arm 40. The arm 40 is preferably of a metallic material such as iron or aluminum, but can be of other materials having the necessary strength characteristics.

The arm 40 is operatively engaged with both the first vertical member 12 and the second vertical member 30. Operative engagement with the second vertical member 30 involves placement of the arm 40 in the retainer 36 such that the weight and other downward vertical forces on the arm 40 are transmitted vertically downward through the retainer, to the second vertical member 30 and are transmitted in this manner to the floor 14. The operative engagement of the arm 40 with the first vertical member 12 includes contact of the second end 56 with first and second cross beams 58, 60 which are attached to the first and second struts 18, 20. Contact of the arm 40 with the first and second cross beams 58, 60 is such that the upper surface of the second end 56 of the arm 40 contacts a portion of the lower surface of the first and second cross beams 58, 60. In this way, the arm 40 operates in a fashion similar to a lever with the second vertical member 30 and retainer 36 acting as a fulcrum. Thus, when a downward force is exerted on the free end 42 of the arm 40, an upward force is exerted on the second end 56 of the arm 40 and thus transmitted to the first and second cross beams 58, 60 thence to the first vertical member 12 to be transmitted to the ceiling 16. Because the first and second cross bars 58, 60 are positioned symmetrically with respect to the first vertical member 12, an upward force on the second end 56 of the arm 40 produces a substantially vertically directed force onto the first vertical member 12 so that the force being transmitted to the ceiling 16 creates a substantially compressional force on the upper portion of the first vertical member 12. There is little or no lateral component to the force which would tend to tilt the anchor 10 out of vertical orientation. Similarly, when a downward force is exerted on the free end 42 of the arm 40, a downward force is transmitted to the second vertical member 30, so that the force being transmitted vertically downward to the floor 14 has little or no lateral component which would tend to tilt the anchor 10 out of vertical orientation.

The first and second cross beams 58, 60 are preferably in the form of channel beams made of a metallic material such as iron or aluminum, but can be of other materials or other shapes consistent with the necessary strength requirements. The first and second cross beams 58, 60 are attached to the first vertical member 12 by bolts, but can also be attached by welding or other similar means. The first and second cross beams 58, 60 are attached to the first vertical member 12 at a height such that when the arm 40 lies in the slot 38 of the retainer 36 and the upper surface of the second end 56 of the arm 40 contacts the lower surface of the cross beams 58, 60, the arm 40 will be in a substantially horizontal orientation.

The height of the horizontally oriented arm 40 with respect to the floor 14 will depend upon the heights of the second vertical member 30 and the first and second cross beams 58, 60. The arm 40 must be of a height to project through available openings such as windows. Additionally, the arm 40 should be of a height such that an evacuee can be attached to the rope 44 while standing on the floor 14 and can then step outward from the building in a manner described below, transferring his weight to the rope 44 without undergoing any vertical drop before being held by the rope 44. The height which will suffice for these purposes may be constrained by the configuration of the building, such as by the height of window ledges, etc. In most instances, a height of the arm 40 above the floor 14 of about 5 1/2 feet will be operable.

When the apparatus is in its storage location, the rope 44 preferably resides on a spool and one end of the rope 44 is attached to a lightweight guide rope which is pre-threaded through the apparatus such that when the anchor is positioned and erected, the guide rope can be pulled to thread the rope 44 through the anchor 10 to lie in a desired pathway. When the rope 44 is in the desired pathway, the rope 44 has a first portion 62 hanging downward from the first rope guide 52 which is positioned proximate the free end 42 of the arm 40. A second portion 63 of the rope 44 also depends from the first rope guide 52. The rope 44 can be of any type which has sufficient strength to support a plurality of evacuees preferably with a safety factor of at least 4 to 1, and also to withstand the friction and abrasion developed by the descent control, braking, and rope guide devices. The rope 44 must be of sufficient length to engage with the descent control and braking device described below and still reach from the arm 40 to a destination point. Sufficient length of rope to provide some margin of safety, such as about 50 feet greater than minimally required, is preferred, although an excessive amount of rope should be avoided to minimize the weight of the device. The additional length of rope, e.g. 50 feet, is useful for assuring that the rope 44 does not travel completely through the pathway and become detached from the anchor 10. Alternatively or additionally, the first and second portions 62, 63 of the rope 44 can be provided with a knot or other device to prevent the rope 44 from slipping completely through the rope pathway of the anchor 10 and becoming detached from the anchor 10. The destination point can be the ground level, or can be an intermediate level such as a ledge or balcony.

A third portion of the rope 64 intermediate the first and second portions 62, 63 is engaged with the descent control and braking device. The part of the rope which engages with descent control and braking device will change as the rope passes through the apparatus. The preferred descent control and braking device is a friction drum 65 having two cylindrical portions 66, 68 projecting laterally outward of a portion of the second vertical member 30. Although separate descent control and braking devices could be provided, in the preferred embodiment, a single friction drum 65 is operative to both control the rate of descent of evacuees and allow for braking the movement of the rope. The axis of the friction drum 65 is substantially perpendicular to the longitudinal axis of the arm 40. The friction drum 65 is attached to the second vertical member 30 by bolting, welding, etc. The friction drum 65 has a surface which is sufficiently smooth to minimize abrasion of the rope, and joins the second vertical member 30 in a smooth fashion to avoid any sharp or jagged edges which the rope 44 might contact. Flanges 70 are provided on the outward faces of the friction drum 65 to prevent the rope 44 from slipping off the end of the drum 65.

The path of the rope 44 is best understood by following the rope from the first portion 62 to the second portion 63. From the first portion 62, the rope passes over the first rope guide 52, and horizontally through the space between the first and second channel beams 46, 48 to pass over the top of the second rope guide 54. From the top of the second rope guide 54, the rope passes downward to contact the first portion 66 of the friction drum 65 on the side facing towards the first vertical member 12. The rope then passes under the first portion of the friction drum 66 and is reaved around the second vertical member 30 across the surface which faces away from the first vertical member 12. For this reason, at least this portion of the second vertical member 30 should be smooth to prevent abrasion of the rope. The rope then passes beneath the second portion of the friction drum 68 and upward around the surface of the second portion of the friction drum 68 which faces towards the first vertical member 12. The rope then passes upward to the second rope guide 54, over the top of the second rope guide 54, through the space between the first and second channel beams 48, 46 and over the top of the first rope guide 54. The second portion of the rope 63 hangs down from the first rope guide 54. Before the first descent, the second portion of the rope 63 preferably resides at the evacuation location in an orderly fashion, such as being coiled, spooled, balled, etc., until it travels through the apparatus during the first descent, as described below.

It will be noted that the path of the rope 44 is symmetric in the sense that the description of the path taken by the rope 44 is unchanged if the rope is followed from the second portion 63 towards the first portion 62.

The friction drum 65 has sufficient diameter that, in combination with the portion of the second vertical member 30 which contacts the rope, sufficient contact between the rope 44 with the friction drum 65 and vertical member 30 is present that the friction developed as the rope slides around the friction drum 65, preferably under the control of an operator, controls the rate of descent of evacuees to a safe rate even when a plurality of evacuees is attached to the rope 44. The amount of friction which is necessary depends to some extent on the number of evacuees the system is designed to handle. A friction drum 65 with a diameter of about 4 inches attached to a first vertical member 30 with a diameter of about 2 inches is operable to control the descent of as many as 10 or more evacuees using a synthetic rope. Some amount of friction will also be produced between the rope and the rope guides 52, 54 which is also useful for controlling the rate of descent of evacuees.

Friction drum 65 is also operable as a braking device. Braking can be accomplished in a number of ways, the simplest being for the operator merely to grasp the rope 44. A single operator is able to brake the rope, even when weighted with a plurality of evacuees, by merely grasping it because of the high amount of friction developed by the braking device. Another method for braking is to reave a portion of the rope one or more turns around the friction drum 65. Although in the preferred embodiment the same components, namely the friction drum 65 and second vertical member 30, operate to provide the function of both the descent control device and the braking device, the function and thus the design constraints of these two different functions of the friction drum 65 are different. The descent control device needs only sufficient friction to slow the descent of the evacuees to a safe rate, while the braking device must be capable of allowing a complete halt of the descent.

The manner of operation of the escape apparatus and method of escape will now be described. Upon outbreak of a fire or other emergency, the evacuees will select a safe evacuation site such as a portion of the building opposite to the location of the fire. The evacuation site must contain an opening to the outside of the building, such as a window or balcony or must open on an interior space extending downward, such as an atrium or an elevator shaft. The escape apparatus is moved from its storage position to the selected escape site. The anchor 10 is positioned sufficiently close to the window or balcony ledge that the arm 40 will project about 10 to 12 inches outward of the building. The anchor is positioned with the first vertical member 12 and the second vertical member 30 placed firmly on the floor 14 and oriented substantially vertically. If the evacuation site contains a false ceiling which does not have sufficient strength to bear the forces imparted on the anchor 10, portions of the false ceiling are removed to provide access to a sufficiently strong ceiling region. When a false ceiling is of the acoustic tile type, the panels of the ceiling can often be simply lifted out. If the false ceiling is of a plaster or drywall type, it may be necessary to form holes in the ceiling, such as by using an ax. If the upper ends of either or both of the struts 18, 20 are too far from the ceiling 16 to allow the screw jacks 22 to be operated so as to contact the struts 18, 20 with the ceiling 16, telescoping extensions 27 are extended and locked in place with pins 29. The handles 24 of the screw jacks 22 are rotated to vertically expand the first vertical member 12 until the top of the first vertical member 12 touches the ceiling 16. The handles 24 are further rotated to exert pressure so as to press or wedge the first vertical member between the floor 14 and ceiling 16. Sufficient force must be developed in wedging the first vertical member 12 to resist tilting of the anchor 10 out of vertical alignment.

The guide rope is pulled to thread the rope 44 through the anchor 10 to reside in the rope pathway described above. Because the apparatus is used in a symmetric fashion, with each end of the rope being employed, in turn, to lower evacuees, for ease of discussion, that portion of the rope hanging from the free end 42 of the arm 40 employed to lower evacuees is referred to as the descending rope, while the portion of the rope descending from the free end 42 of the arm 40 which is not being used for lowering evacuees is referred to as the ascending rope. As is obvious, as the rope is used in an alternating fashion, as described below, or as the rope travels through the rope guides and friction drum, a particular portion of the rope which at one point in time is an ascending rope, will at another point in time be the descending rope. Thus, reference to a portion of the rope as ascending or descending, is pertinent only with respect to a given point in time.

Sufficient harnesses 72, 78 are provided for use by a plurality of evacuees. Preferably, the number of harnesses 72, 78 is restricted so as to make it unlikely that the escape system will be overloaded.

The braking device is employed to hold the rope 44 in a stationary position as the first evacuee is attached thereto. A first harness 72*a* for use by a first evacuee is attached to a location along the first portion of the rope 62 and below the free end 42 of the arm 40. The harness can be of any of a number of types well known in the art and is preferably of a type which can accommodate an unconscious or otherwise incapacitated person. The attachment means can be any of a number of types known in the art and preferably is of a type which can be attached to an intermediate portion of a rope without the necessity for threading an end of the rope therethrough and which does not require any knotting or permanent fixtures attached to the rope. One such attachment device is a cam-lock attachment device having a means for attaching a harness thereto, such as using a carabiner. The first evacuee is placed in the first harness 72*a*, either before or after its attachment to the rope 44. After attachment of the harness 72*a* to rope 44, the first evacuee steps outward from the edge of the balcony or window, thus transferring weight to the rope 44 but experiencing little or no vertical drop before engaging with the rope 44. The ability of an evacuee to move outward of the building on his harness, so as to transfer weight to the rope, without significant drop, relates to the elevated position of the arm 40. The arm 40 is preferably positioned overhead of the evacuees so that the harness can be attached to the rope so as to extend from the evacuee to the rope with substantially no slack. The evacuee, at this point, is standing at the edge of the building floor or, if there is a window ledge or a railing, the evacuee can be sitting on the ledge or railing with th feet outward of the ledge or railing. Once the harness is donned and is securely attached to the rope and extending at angle outward of the building and upward to meet the rope with substantially no slack, the evacuee can step off the edge of the floor or the ledge or railing so that the evacuee's weight is transferred to the rope. In this way, the evacuee moves outward of the building to be supported by the rope but does not experience a vertical drop during the process.

The braking device is then released, such as by an operator loosening his grasp on the rope 44 or by removing portions of the rope from the friction drum 65. When braking is released, the weight of the first evacuee causes the rope 44 to be pulled through the rope guides 52, 54 and friction drum 65 and causes the first evacuee to descend. When the first evacuee has descended some distance, for example about 5 feet, the descent of the rope 44 is braked, as described above, to permit attachment of the next evacuee. A second harness 72*b* is attached below the arm 40 to the descending rope, in the manner already described with relation to the attachment of the first harness 72*a*. The second harness 72*b* is used by a second evacuee who steps outward of the edge of the window or balcony, as did the first evacuee and the weight of the second evacuee is transferred to the rope 44. Braking of the rope 44 is released and the first and second evacuees are lowered another distance, for example about 5 feet, and the rope is again braked to permit attachment of a third evacuee. Lowering evacuees, braking the rope and attaching further evacuees is continued in this manner until a number of evacuees, for example about 10, are attached to the descending rope. At this point, braking on the rope is relaxed and the first group of evacuees is lowered to the destination point using the descent control means.

When the first group of evacuees has reached the destination level, the symmetric aspect of the rope pathway as described can be employed to reverse the roles of the ascending and descending portions of the rope in the following manner. The second portion of the rope 63 is positioned to hang downward from the arm 40 if this has not already been done. A second plurality of harnesses 78 for use by a second plurality of evacuees is attached, one at a time, to a location along the second portion of the rope 63. Thus, a portion of the rope which was ascending during the escape of the first group of evacuees is descending during the escape of the second group of evacuees. The second group of evacuees is attached to the rope in the same manner as was described above in relation to the attachment of the first group of evacuees, i.e. a harness 78*a* is attached to the rope 44, and the rope is lowered a distance, e.g. about 5 feet. If the first portion of the rope 62 is particularly long or heavy, or if the first evacuee in the second group is particularly light, it may be necessary for an operator to feed a portion of the rope through the apparatus by hand. After the second portion of the rope 63 is lowered a distance, e.g. about 5 feet, the rope is braked, and the next harness 78*b* is attached for use by the next evacuee. The first and second evacuees are lowered a distance, e.g. about 5 feet, and the rope is then braked for attachment of the third harness 78*c*. This process is continued until a number of evacuees are attached to the rope at which point the braking is released and the second group of evacuees is lowered to the ground.

Figure 3:
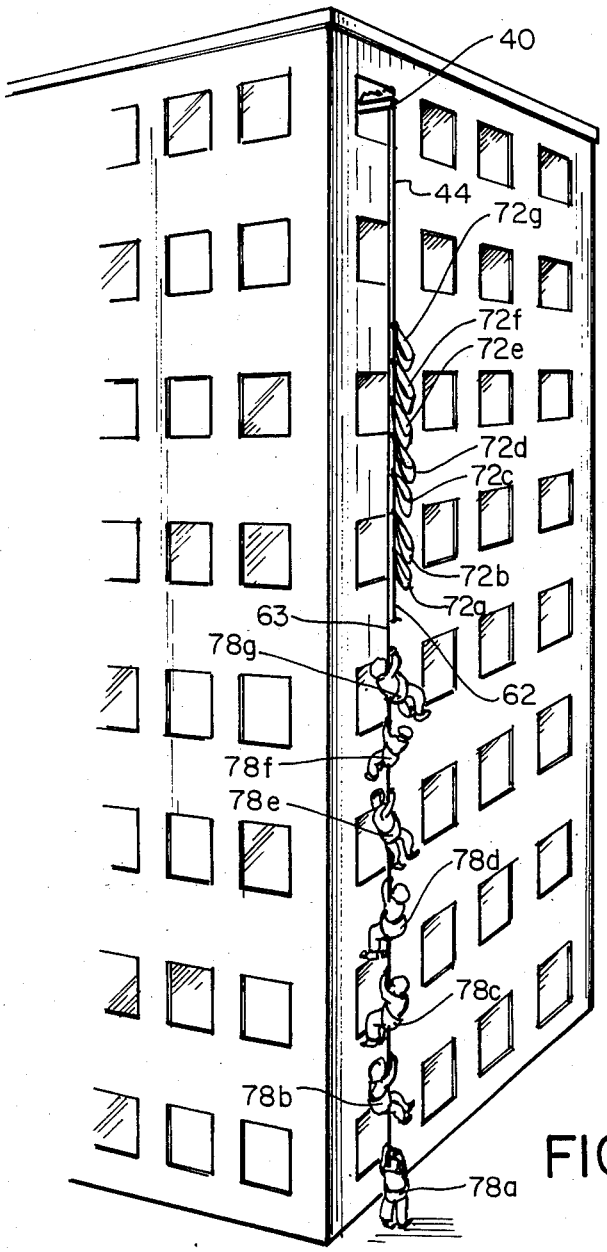
FIG. 3 is a perspective view showing the invention being used to lower evacuees from a building while simultaneously raising harnesses for use by a subsequent group of evacuees.

As depicted in FIG. 3, the second group of evacuees, employing the second plurality of harnesses 78 act as a counterweight to the weight of the ascending rope and the harnesses 72 attached thereto. As the first group of harnesses 72 arrived back at the evacuation site, they are removed from the rope 44 for reuse and as may be necessary to prevent jamming the harnesses or attachment means in the arm 40.

The ascending and descending roles of the rope 44 are again reversed and the first plurality of harnesses 72 are attached to the first portion of the rope 62 for escape of a third group of evacuees. In this manner, the first portion 62 and second portion 63 of the rope 44 are alternately employed as a descending portion of the rope.

The ascending portion of the rope can be used not only to raise harnesses for reuse but can also be used to raise personnel such as firefighting or other emergency personnel and/or equipment such as firefighting equipment. This method of use is generally similar to the use described above. Namely, a harness is attached to the descending portion of the rope for use by a first evacuee. The evacuee in the harness is lowered a distance, e.g. about 5 feet, the rope is braked and a second evacuee and harness is attached to the descending portion of the rope. As above, a number of evacuees are attached to the descending portion of the rope in this fashion. After attachment of at least some of the evacuees to the descending portion of the rope, personnel and/or equipment are attached to the ascending portion of the rope. After all evacuees have been attached to the descending portion of the rope and the emergency personnel and/or equipment have been attached to the ascending portion of the rope, the evacuees are lowered using the descent control means, with braking being controlled by an operator as necessary. The weight of the evacuees acts as a counterweight to the weight of the emergency personnel and/or equipment and thus assists in raising the personnel and/or equipment.

In an embodiment in which there is only a single evacuee to be lowered while another person is to be raised, the evacuee is attached to the descending portion of the rope and the person to be raised is attached to the ascending portion of the rope while the evacuee is still adjacent to the evacuation site. The weights attached to the ascending and descending portions of the rope being approximately of the same magnitude, raising of the emergency personnel and lowering of the evacuee is accomplished by feeding the rope through the rope pathway by hand. This can be accomplished by a person at the evacuation site by, for example, pulling on a portion of the rope between the second rope guide 54 and the friction drum 65. When there is no operator present, the evacuee can pull upward on the portion of the ascending rope which is lateral to the position of the evacuee until the evacuee is laterally adjacent the person being raised. At this point, the person being raised can pull downward on the descending portion of the rope and thus raise himself to the evacuation site, using the weight of the evacuee as a counterweight.

The first and second portions of the rope 62, 63 are alternately employed as a descending portion of the rope until the penultimate group of evacuees has reached the ground. At this point, it is preferred to detach at the ground level the harnesses used by the penultimate group of evacuees, because it is usually unnecessary to lift the extra weight of the harnesses during the descent of the last group of evacuees. The evacuation of the last group of evacuees then proceeds as described above in relation to evacuation of previous groups of evacuees. The last evacuee lowers the remaining group of evacuees to the ground, remaining behind so that he can operate the braking device as needed. When the last group of evacuees has reached the ground, the last evacuee descends to the ground by using the rope 44 to rappel downward to the destination level.

A number of variations and modifications on the preferred embodiment of the invention described above can be provided. The anchor can employ permanently mounted brackets for positioning during an emergency or the anchor 10 can be permanently mounted in the building. When the escape apparatus is to be portable, it can be provided in a dis-assembled or folded state for easy portability and can be provided with wheels to assist in moving the apparatus.

A tie-back apparatus and method of the type common in scaffolding use is preferably provided. The tie-back method includes attaching a safety line or rope from the anchor 10 and/or arm 40 to a sturdy and convenient member in the building, for example a pillar, in order to provide for additional safety.

Other mechanisms for controlling the rate of descent or braking the rope can be used. The rope can be reaved about a pulley or rotating spool device with a mechanism for controlling the rate of rotation of the pulley or spool and/or braking the pulley or spool. A clamp-like device can be used to provide descent control or braking friction against the rope, or a number of other devices known in the art such as mechanical, hydraulic or centrifugal devices can be used. Devices can be added to provide guidance to the rope and prevent tangling such as eyelets, tubes, spools, and the like. When the first vertical member 12 cannot be effectively wedged between a floor 14 and a ceiling 16, such as in a rooftop evacuation situation, the anchor 10 can be positioned using guys.

The anchor 10 of this invention can be used in supporting escape mechanisms other than a rope 44, such as a fabric tubular escape device or slide. Such tubular or slide escape device can be attached to the anchor 10 using two arms similar to the arm 40 depicted in FIGS. 1–3.

In view of the preceding description of the apparatus and method of this invention, a number of features and advantages are apparent. The apparatus is portable so as to permit easy positioning of the apparatus where it can be most safely used to escape an emergency without the necessity for permanently mounted fixtures and without the necessity for specially adapting the apparatus to each building or each location of a building where use is contemplated. The apparatus can be provided in a form sufficiently portable that it can be carried into a building by one or two persons. The apparatus contains few parts and in particular contains a descent control and braking device which has no moving parts so as to minimize likelihood of jamming or other malfunction which could suspend evacuees in mid-air. The device is simple to use and can be used by persons who are inexperienced or novice.

The apparatus includes an anchor which is configured to resist tilting by one or more of a number of devices including cross-bracing between vertical members, an expansion of a vertical member to wedge the vertical member between a floor and a ceiling, and connection of an arm with a vertical member so as to assure that forces are transmitted in a substantially upward or downward vertical direction. Use of one or more of these methods or devices for resisting tilting also assists in the adaptability of the device because the anchor can thus be used without having to transmit any substantial amount of force to a wall portion or any anchorage other than a ceiling or floor. Therefore, the anchor can be used where there is no wall portion available, such as in a building with floor to ceiling glass windows or where wall members have insufficient strength to support the weight of the evacuees.

The apparatus can be used to provide for simultaneously raising one portion of the rope and attached harnesses while lowering a group of evacuees. In this way, valuable time can be saved which would otherwise be required to haul up a portion of the rope without lowering evacuees. Furthermore, the weight of the evacuees acts as a counterbalance to the weight of the rope and harnesses which is being raised so that no strength is required to raise the rope and harnesses and the apparatus can be used by inexperienced or novice persons. The rate of descent is controlled to a safe rate, even when a plurality of evacuees are using the device.

The apparatus is relatively inexpensive so that a sufficient number of apparatuses can be provided in a building to permit safe evacuation of all building inhabitants. The apparatus is easily assembled and positioned for use by inexperienced or novice persons.

Although the foregoing invention has been described in some detail by way of illustration and example for purposes of clarity and understanding, it will be obvious that certain changes and modifications may be practiced within the scope of the invention.

What is claimed is:

1. A multiple-person building evacuation apparatus comprising:

anchor means for transmitting substantially all force exerted thereon to a floor and a ceiling, said anchor means being free from contact of any wall of the building wherein no force is directly transmitted from said anchor means to any building wall during the evacuation of one or more persons from the building;

an arm extending outward from said anchor means;

a rope operatively attached to said anchor means and descending from said arm;

first means for removably attaching a harness to said rope in a fixed relationship relative to said rope;

second means for providing control over rate of descent; and third means for braking movement of said rope to permit use thereof by a plurality of evacuees in a single descent.

2. The apparatus of claim 1 wherein said anchor means includes vertical means and cross means, said cross means being substantially normal to said vertical means and being positioned to transmit forces from said arm in substantially the same vertical plane as said vertical means to avoid tilting of said vertical means during evacuation.

3. The apparatus of claim 2 wherein said vertical means includes at least a first vertical strut and said cross means includes first and second cross members, said first cross member being located on a side of said first vertical strut opposite that of said second cross member.

4. The apparatus of claim 1 wherein said second means comprises a friction drum.

5. The apparatus of claim 1 wherein said third means comprises a friction drum.

6. The apparatus of claim 1 wherein said anchor means includes:

a first vertical member extending to a ceiling; and a second vertical member extending from said arm intermediate said first and second ends to a floor

7. The apparatus of claim 6 wherein said arm is operatively engaged with said first vertical member such that an upward force on said second end of said arm transmits a vertical force to said first vertical member, said force being substantially vertical in direction to resist tilting of said first vertical member.

8. The apparatus of claim 6 wherein said means for resisting tilting comprises means for expanding said first vertical member to wedge said first vertical member between a ceiling and a floor, and wherein substantially all force exerted on said first vertical member is transmitted to the floor and ceiling.

9. The apparatus of claim 6 wherein said means for resisting tilting comprises bracing members attached between said first and said second vertical members.

10. A method for evacuating a plurality of persons from a portion of a building having a floor and a ceiling to a lower destination point comprising:

providing an anchor having means for resisting tilting of said anchor out of vertical alignment wherein substantially all force exerted on said anchor is transmitted to the floor and ceiling;

maintaining said anchor free from contact of any wall of the building;

providing an arm having first and second ends operatively engaged with said anchor, said arm projecting outward of said anchor;

providing a rope having first and second portions;

hanging said first portion of the rope from said first end of said arm;

connecting a second portion of said rope to braking and descent control means;

attaching a first harness to said first portion for use by a first evacuee;

lowering said first evacuee, using said first harness, to a position intermediate said arm and the destination point using said descent control means;

avoiding substantially the direct transmission of a force from said anchor to any wall of the building during said lowering of said first evacuee;

halting the descent of said first evacuee using said brake means;

attaching a second harness to said rope for use by a second evacuee; and lowering said first and said second evacuees to said destination point using said descent control means.

11. The method of claim 10 wherein said means for resisting tilting comprises bracing members attached between said first and said second vertical members.

12. The method of claim 10 wherein said means for resisting tilting comprises means for operatively engaging said arm with said first vertical member such that an upward force on said second end of said arm transmits a force to said first vertical member, said force being substantially vertical in direction.

13. An anchor apparatus for use in lowering persons from a building comprising:

a first vertical member, said first vertical member including first and second struts;

cross means connected between said first and second struts, said cross means being positioned to prevent tilting of said first vertical member when a person is being evacuated;

expansion means on said first vertical member for wedging said first vertical member between a ceiling and a floor;

an arm having a first end and a second end, said second end operatively engaged with said first vertical member;

a second vertical member extending from said arm intermediate said first and second ends to said floor; and bracing attached between said first and said second vertical members configured to resist tilting of said first vertical member out of vertical orientation in response to a force with a lateral component.

14. The apparatus of claim 13 wherein said expansion means comprises a screw jack.

* * * * *